US007798304B2

(12) United States Patent
Takeuchi

(10) Patent No.: US 7,798,304 B2
(45) Date of Patent: Sep. 21, 2010

(54) COIN DISPENSING APPARATUS

(75) Inventor: Toru Takeuchi, Saitama (JP)

(73) Assignee: Asahi Seiko Co., Ltd., Saitama (JP)

( * ) Notice: Subject to any disclaimer, the term of this patent is extended or adjusted under 35 U.S.C. 154(b) by 347 days.

(21) Appl. No.: 11/625,466

(22) Filed: Jan. 22, 2007

(65) Prior Publication Data

US 2007/0170036 A1 Jul. 26, 2007

(30) Foreign Application Priority Data

Jan. 23, 2006 (JP) ..... 2006-014423

(51) Int. Cl.
*G07D 5/08* (2006.01)

(52) U.S. Cl. ..... 194/327; 194/215; 194/302; 194/325; 194/326; 453/10; 453/13; 453/33; 453/49; 453/57

(58) Field of Classification Search ..... 453/57, 453/1, 2, 6, 10, 12, 13, 33–35, 49, 58; 194/325–327, 194/215–217, 302, 303
See application file for complete search history.

(56) References Cited

U.S. PATENT DOCUMENTS 4,667,093 A * 5/1987 MacDonald ..... 250/223 R
4,923,430 A * 5/1990 Iimura ..... 453/50
5,616,074 A * 4/1997 Chen ..... 453/30
6,503,138 B2 * 1/2003 Spoehr et al. ..... 453/10
6,679,770 B1 * 1/2004 Sugai et al. ..... 453/10
6,766,892 B2 * 7/2004 Martin et al. ..... 194/317
2005/0003750 A1 * 1/2005 Inuki et al. ..... 453/57

FOREIGN PATENT DOCUMENTS

JP 2000-353262 12/2000
JP 2004-213093 7/2004

* cited by examiner

*Primary Examiner*—Jeffrey A Shapiro
(74) *Attorney, Agent, or Firm*—McGlew and Tuttle, P.C.

(57) ABSTRACT

A coin dispensing apparatus is provided which can detect a dispensed coin without lowering a dispensation speed of coins, even dispensed small-diameter coins without lowering a dispensation speed without damaging a coin detecting device. The coin dispensing apparatus has a throwing-out device and a noncontact type detecting device. A rebound member is provided against which the coin thrown out by the throwing-out device strikes, to rebound in a predetermined direction. The noncontact type coin detecting device continuously detects a coin before the coin strikes against the rebound member and after the coin rebounds.

18 Claims, 8 Drawing Sheets

- PRIOR ART-

COIN DISPENSING APPARATUS

CROSS REFERENCE TO RELATED APPLICATIONS

This application claims the benefit of priority under 35 U.S.C. §119 of JAPAN Patent Application JP 2006-014423 filed Jan. 23, 2006, the entire contents of which are incorporated herein by reference.

FIELD OF THE INVENTION

The present invention relates to a coin dispensing apparatus provided with a coin detecting device which detects dispensed coins in non-contacting manner. In particular, the present invention relates to a coin dispensing apparatus provided with a coin detecting device which detects small-diameter coins in a non-contacting manner. Further, the present invention relates to a coin dispensing apparatus provided with a noncontact type coin detecting device which is suitable for a coin dispensing apparatus using a rotating disk. The word "coin" used in this specification includes coin currency, tokens, medals, disks and the like, and the shape thereof includes a circular shape and a polygonal shape and other generally cylindrical similar disk type media.

BACKGROUND OF THE INVENTION

JP-A-2004-213093 (see especially FIGS. 1 to 8, Pages 2 to 6) presents an example of a coin dispensing apparatus which dispenses coins after the coins have been individually sorted by a rotating disk. The dispensed coins are detected by a magnetic sensor which is a noncontact type detecting device.

JP-A-2000-353262 (see especially FIGS. 1 to 4, Pages 2 to 3) presents an example of coins being individually sorted by a rotating disk, and then, coins are flipped out by a fixed roller and a movable roller which is biased by a resilient member so as to approach the fixed roller. The flipped-out coins are caused to strike against a guiding unit to change a discharge direction.

With the device disclosed in JP-A-2004-213093, in order to prevent false dispensation due to false detection, such a configuration is adopted that a detection signal is output when the dispensed coin is continuously detected by a noncontact type coin detecting device during a predetermined time period. Though the predetermined time period is determined according to a coin speed and a length of a coin facing the noncontact type coin detecting device, the coin speed can be controlled in a predetermined range. However, in order to perform coin dispensation rapidly, lowering of the coin speed is limited. On the other hand, since the length of the coin facing the noncontact type coin detecting device is influenced by a size of a coin, making the length longer is also physically restricted. As a small-diameter coin is short in length as to the coin facing such a noncontact type coin detecting device, when the coin speed is fast, a detection signal may not be output continuously during the predetermined time period even if a coin is dispensed normally. Though it can be thought to lower a dispensation speed of coins in this case, dispensation of coins cannot be performed rapidly, so that lowering the dispensation speed cannot be adopted readily.

In the device of JP-A-2000-353262, the coins flipped out by the movable roller strike against the guiding unit and rebound in a predetermined direction, so that the dispensation direction from the coin dispensing apparatus is changed. However, JP-A-2000-353262 only discloses the dispensed coins being caused to strike against the guiding unit in order to simply change the dispensation direction and does not present any suggestion or implication as to any combination with the other components.

SUMMARY OF THE INVENTION

A first object of the present invention is to provide a coin dispensing apparatus which can detect dispensed coins without lowering a dispensation speed of coins.

A second object of the present invention is to provide a coin dispensing apparatus which can detect dispensed small-diameter coins without lowering a dispensation speed.

A third object of the present invention is to provide a coin dispensing apparatus which can detect dispensed small-diameter coins without damaging a coin detecting device.

According to the invention a coin dispensing apparatus is provided where coins thrown out by a throwing-out device are detected by a noncontact type coin detecting device. A rebound member is provided, against which coins thrown out by the throwing-out device strike to rebound in a predetermined direction. A noncontact coin detecting device is provided which continuously detects the coins before striking against the rebound member and the coins after rebounding.

With the construction according to the invention, the coins thrown out by the throwing device strike against the rebound member to rebound in the predetermined direction to be dispensed. Coins are dispensed via a V-shaped path where a struck portion on the rebound member is a point of change of direction. Then, the noncontact type coin detecting device detects coins continuously from before the coins strike against the rebound member until after striking against the rebound member. As such, the length where the noncontact type detecting device faces the coin is extended corresponding to rebounding of the coin. In a case of the same speed, a detection signal can be obtained which is prolonged in terms of a time period corresponding to increase of a length where the coin and the noncontact type coin detecting device face each other due to rebound. Therefore, since the length of a signal which allows coin detection can be obtained without lowering the dispensation speed of a coin, there is an advantage of being capable of performing reliable coin detection.

The coin dispensing apparatus may have the coins sorted to respective ones by rotating a rotating disk having through holes to drop coins into the through hole. The coins are flipped out by a fixed guiding member and a movable guiding member which is resiliently biased, and the flipped-out coins are detected by a noncontact type coin detecting device. A rebound member against which the coins flipped out by the fixed guiding member and the movable guiding member strike at an acute angle may be provided, and each coin before striking against the rebound member and each coin after rebounding may be detected continuously.

In this constitution, coins may be dropped into the through holes to be rotated according to rotation of the rotating disk, and the coins may be pushed out in a peripheral direction of the rotating disk while being guided by the fixed guiding member at a predetermined position. In a course of pushing the coin out in the peripheral direction of the rotating disk, the movable guiding member may be moved against a spring force of a resilient member by the coin. Then, since the movable guiding member is returned forcefully by the spring force of the resilient member just after a diameter portion of each of the coins passes through between the fixed guiding member and the movable guiding member, the coins are flipped out. The flipped-out coins advance straight through the air and strike against the rebound member at a predetermined acute incident angle. The struck coins are repelled by reaction of the rebound member at a reflection angle approximately equal to the incident angle, and dispensed in a predetermined direction. As such, since the coins follow a V-shaped path to be dispensed, the advantageous function and effect as mentioned above according to the invention can be obtained.

The noncontact type coin detecting device may advantageously be an electromagnetic type coin detecting device in the coin dispensing apparatus. With such a constitution, in addition to the effects of the invention noted above, the thrown-out coins are detected by the electromagnetic type coin detecting device. Since the electromagnetic type coin detecting device is not influenced by dust, debris, refuse, and the like, a detection signal with high reliability can be obtained unless the electromagnetic type coin detecting device itself breaks down. This presents an advantage of achieving a maintenance-free apparatus easily.

The noncontact type coin detecting device may also be formed into a channel shape with a pair of detecting units forming a path through which coins pass and a connecting portion connecting the detecting units to each other. The rebound member is disposed on the connecting member positioned in a depth portion of the path.

The rebound member may be disposed on the connecting portion connecting the pair of detecting units which constitute a part of the coin detecting device. Even in the case where a direction of a thrown-out coin deviates from a set direction, the thrown-out coin is guided to the pair of detecting units to reach the rebound member, and the coin is also guided to the pair of detecting units just after rebounding. In other words, since a thrown-out coin is guided to the detecting units during a time period from just before reaching the rebound member to just after rebounding, a position thereof becomes stable. Therefore, there is an advantage of being capable of obtaining the detection signal of a coin reliably.

The rebound member may be formed as a member separated from the noncontact type coin detecting device, and may be disposed in the depth portion of the path. With this arrangement, the rebound member disposed in the connecting portion is formed as a member separated from the noncontact type coin detecting device. Therefore, there is an advantage of being capable of changing material for the rebound member to durable material in order to prevent wear or damage due to coins striking same, and being capable of performing this replacement easily even in case of wear or the like.

The present invention provides a coin dispensing apparatus where, after coins are sorted to respective ones by rotating a rotating disk having through holes to drop the coins into the through holes, the coins are flipped out by a fixed guiding member and a movable guiding member which is resiliently biased, and the flipped-out coins are detected by a noncontact type coin detecting device. The noncontact type coin detecting device is formed into a channel shape with a pair of detecting units forming a path through which coins pass and a connecting portion connecting the detecting units to each other. The rebound member formed as a member separated from the noncontact type coin detecting device is disposed adjacent to the connecting portion positioned in a depth portion of the path. The coins flipped out by the fixed guiding member and the movable guiding member strike against the rebound member at an acute angle. Simultaneously with this the noncontact type coin detecting device continuously detects each coin before striking and each coin after rebounding.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
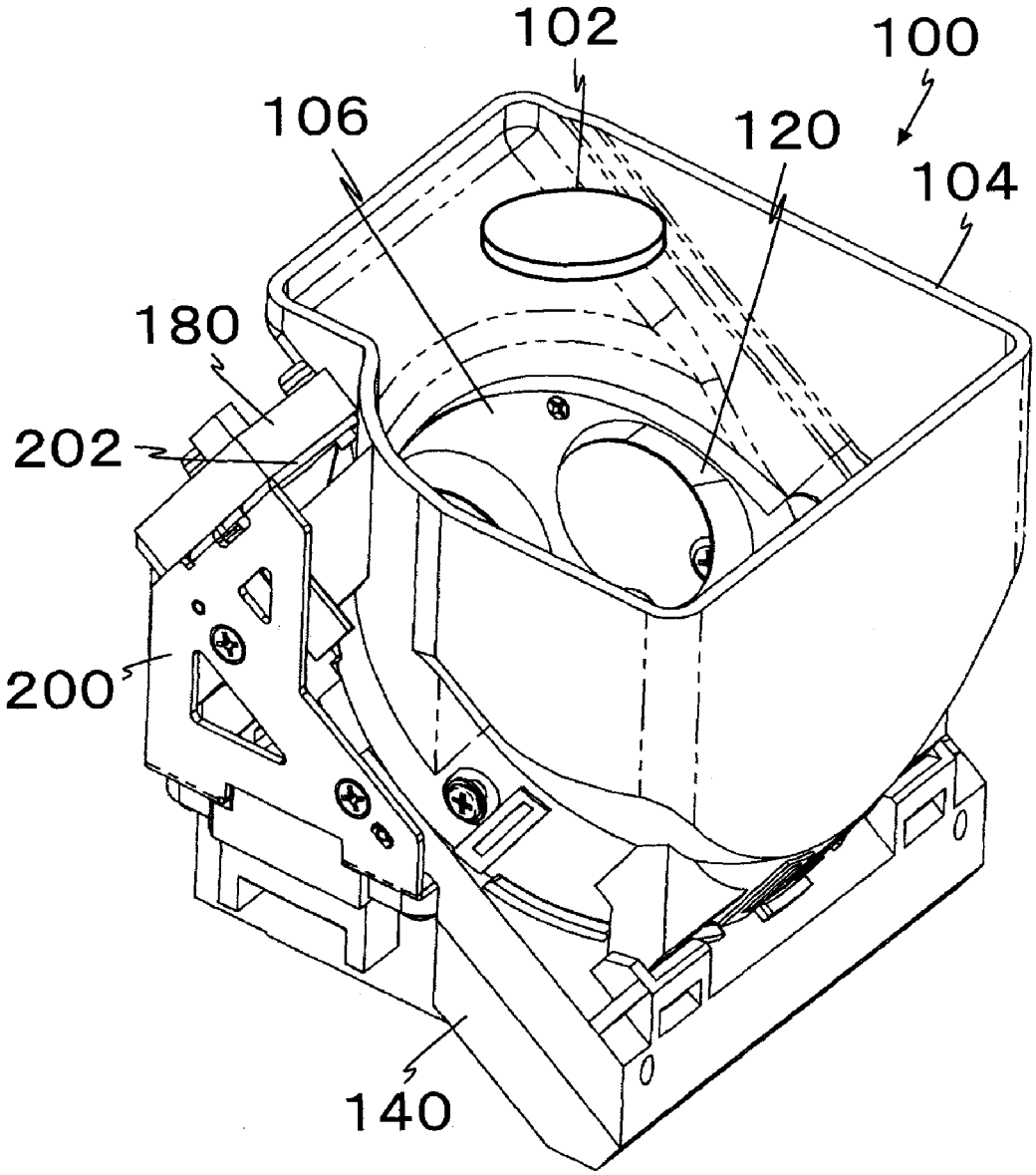
FIG. 1 is a perspective view of a coin dispensing apparatus of a preferred embodiment of the present invention.

Referring to the drawings in particular, a coin dispensing apparatus 100 will be first explained. The coin dispensing apparatus 100 has the function of sorting stored coins 102 to respective denominations or types to dispense the coins 102, and the function of providing an output of detection signals of the dispensed coins 102.

Figure 5:
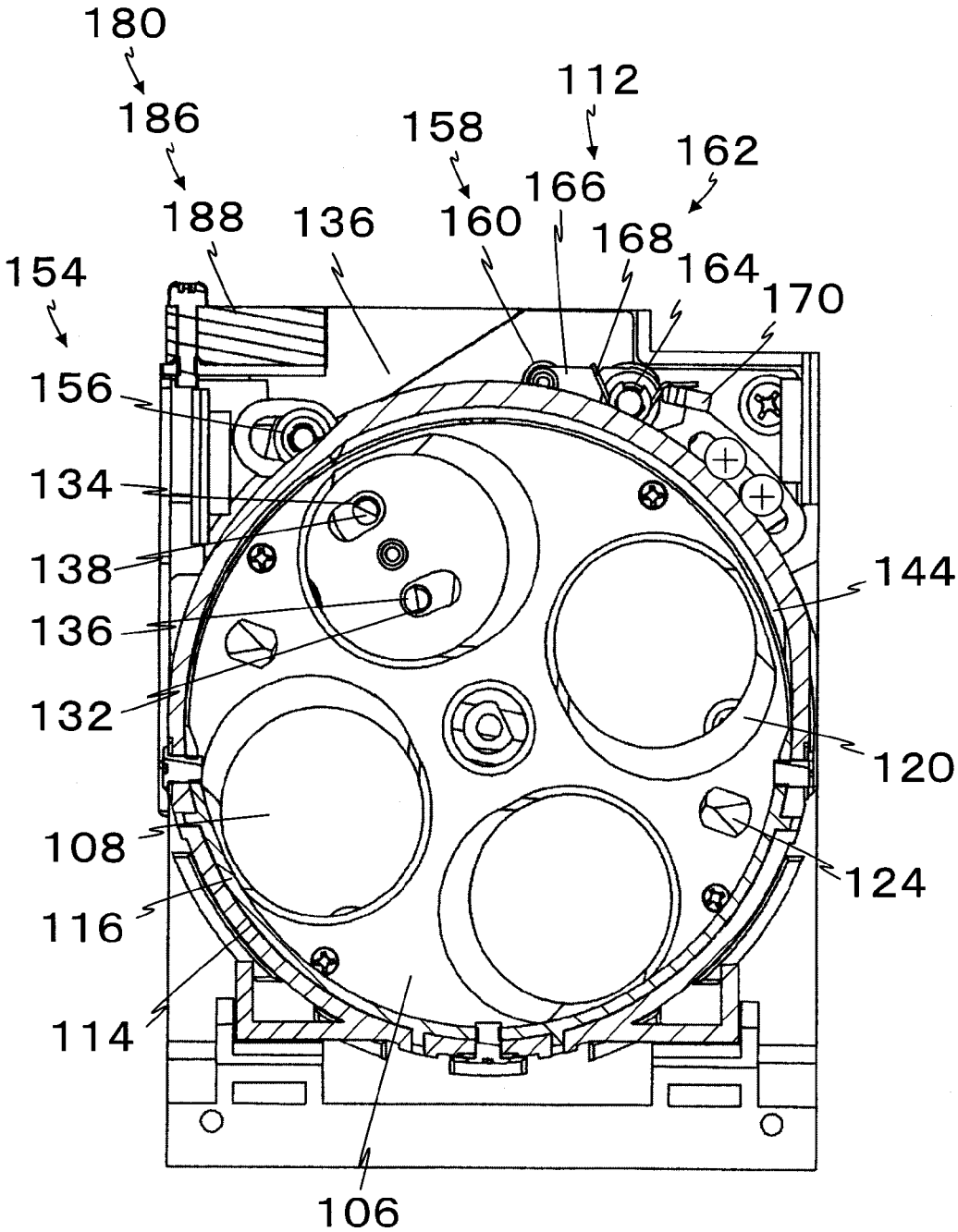
FIG. 5 is a sectional view of the coin dispensing apparatus of the embodiment of FIG. 1, taken along line Y-Y in FIG. 3.
Figure 6:
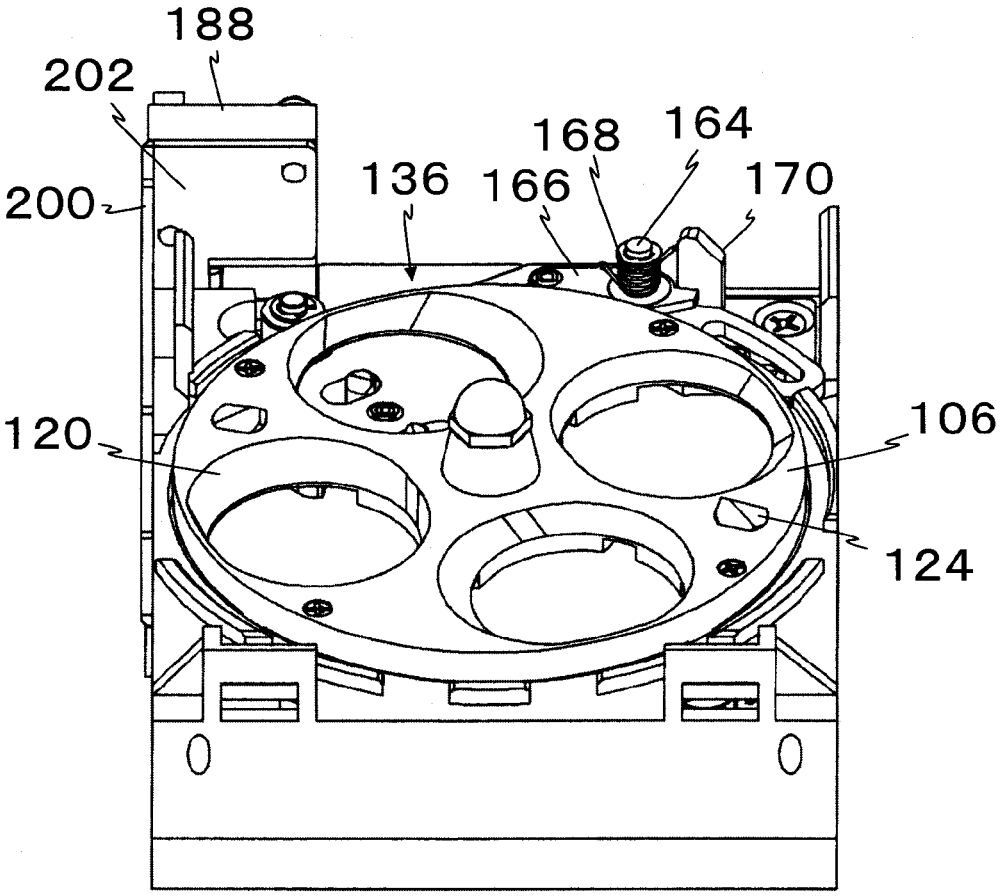
FIG. 6 is a front view of the coin dispensing apparatus of the embodiment of FIG. 1 in a state where a storing bowl has been removed.

The coin dispensing apparatus 100 includes a cylindrical storing bowl 104 for storing the coins 102, a rotating disk 106 disposed on a bottom portion of the storing bowl 104 for sorting the coins 102 to respective denominations or types, a flat-plate-like base 108 on which the coins 102 rotated according to rotation of the rotating disk 106 slide. A motor 110 is provided for rotationally driving the rotating disk 106 and a throwing-out device 112 (FIG. 5) flips coins 102 out. A coin detecting device 180 is described below.

The storing bowl 104 will be explained first. The storing bowl 104 has a cylinder shape extending vertically as a whole. An upper end portion thereof has an approximately rectangular shape, a lower end portion thereof is formed in a circular hole 114, and the storing bowl 104 has a function of storing a lot of coins 102 in a loosely stacking manner. The storing bowl 104 is detachably attached on an upper face of a base frame 140, described below.

Figure 4:
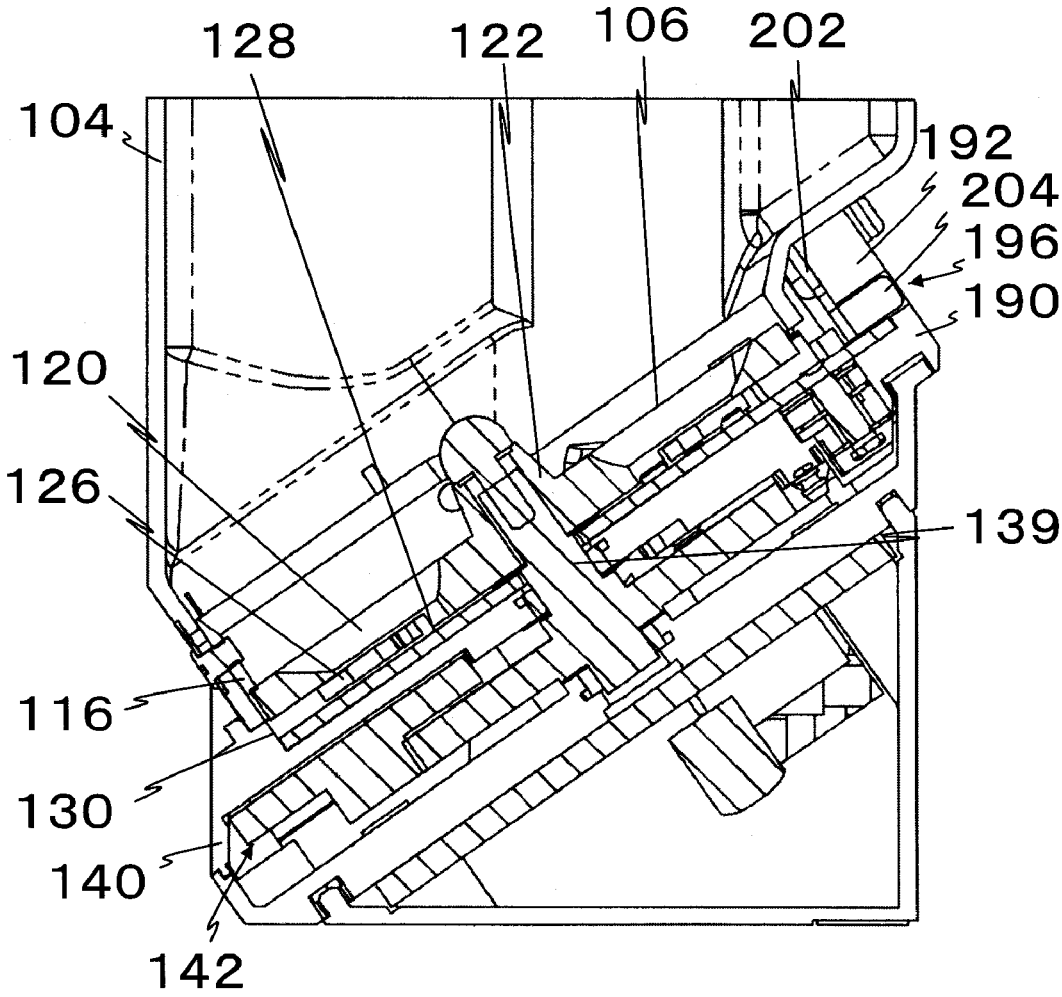
FIG. 4 is a sectional view of the coin dispensing apparatus of the embodiment of FIG. 1, taken along line X-X in FIG. 2.

A coin dropper 116 (FIG. 4) is disposed on the circular hole 114 of the lower portion of the storing bowl 104. The coin dropper 116 is formed in an arc shape and is disposed such that an outer face of the coin dropper 116 comes in close contact with a peripheral face of the circular hole 114. A lower edge thereof faces an upper face of an edge portion of the rotating disk 106. Thereby, the coin dropper 116 has the function of dropping the coins 102, rotating together with the rotating disk 106, into through holes 120 described below.

The coin dropper 116 is formed into a circular arc shape using a resin plate or a metal plate, and both ends thereof are fixed on the storing bowl 104 with a screw 119 penetrating a long hole 118 formed on a side wall of the storing bowl 104.

Figure 3:
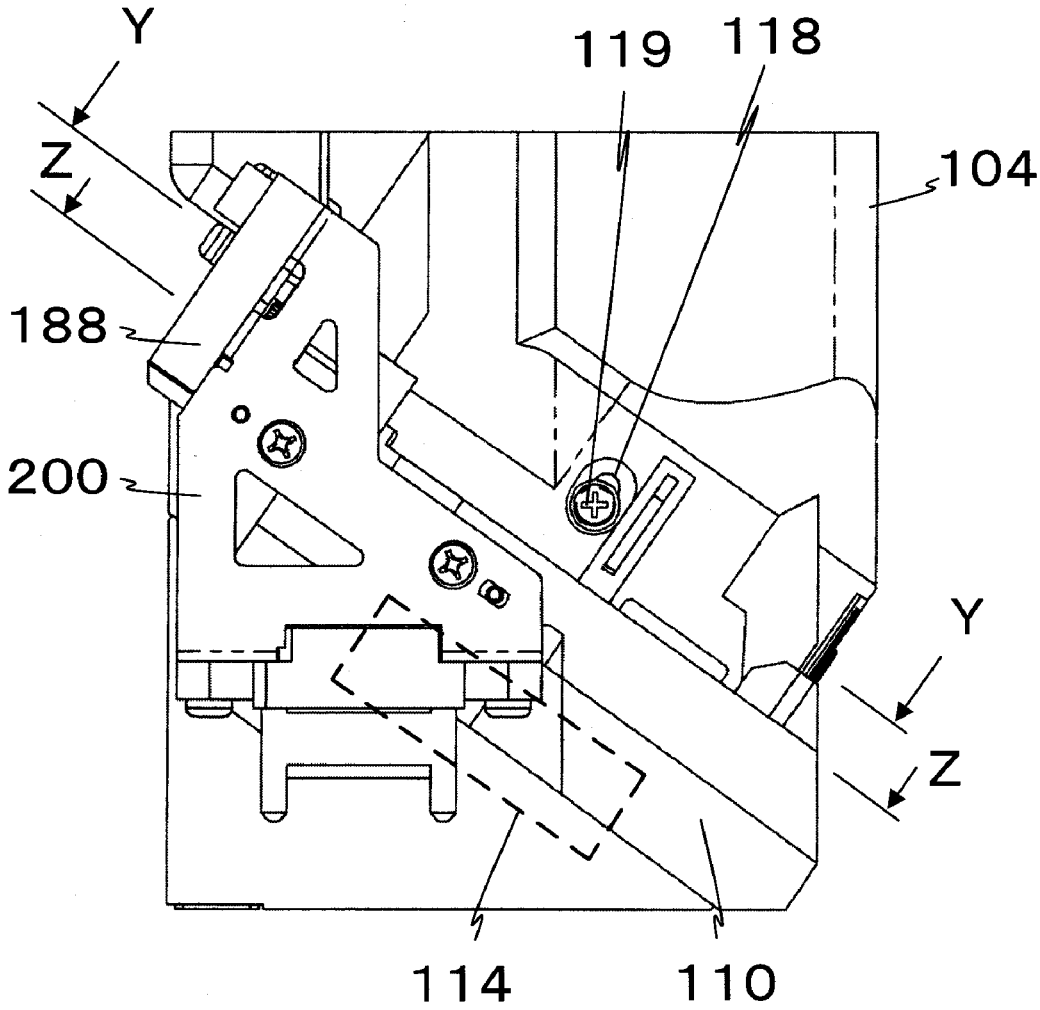
FIG. 3 is a left side view of the coin dispensing apparatus of the embodiment of FIG. 1.

The long hole 118 (FIG. 3) extends in a direction perpendicular to the upper face of the rotating disk 106. Therefore, the coin dropper 116 is attached on the side wall of the storing bowl 104, such that a distance between the coin dropper 116 and the upper face of the rotating disk 106, in other words, a distance between the coin dropper 116 and the base 108, can be position-adjusted along an axial line of the circular hole 114 in a range of the long hole 118. Thereby, a lower end of the coin dropper 116 is positioned just above an edge portion of the rotating disk 106 in the circular hole 114. A distance between an inner face of the coin dropper 116 and an outside edge of the through hole 120 in the rotating disk 106 is set to be less than one half of a thickness of a coin to be stored. It is preferable that an arrangement is made such that an inner face of the coin dropper 116 overlaps with the outer peripheral edges of the through holes 120 when the rotating disk 106 is viewed from the above. Thereby, when the coins 102 are caused to rotate together with the rotating disk 106 on the edge portion of the rotating disk 106, the coins 102 are forced to move to the sides of the through holes 120 by the coin dropper 116, and the edge portion of the rotating disk 106 virtually disappears, so that the coins 102 drop into the through holes 120, and the coins 102 can be dispensed to the last one.

Figure 2:
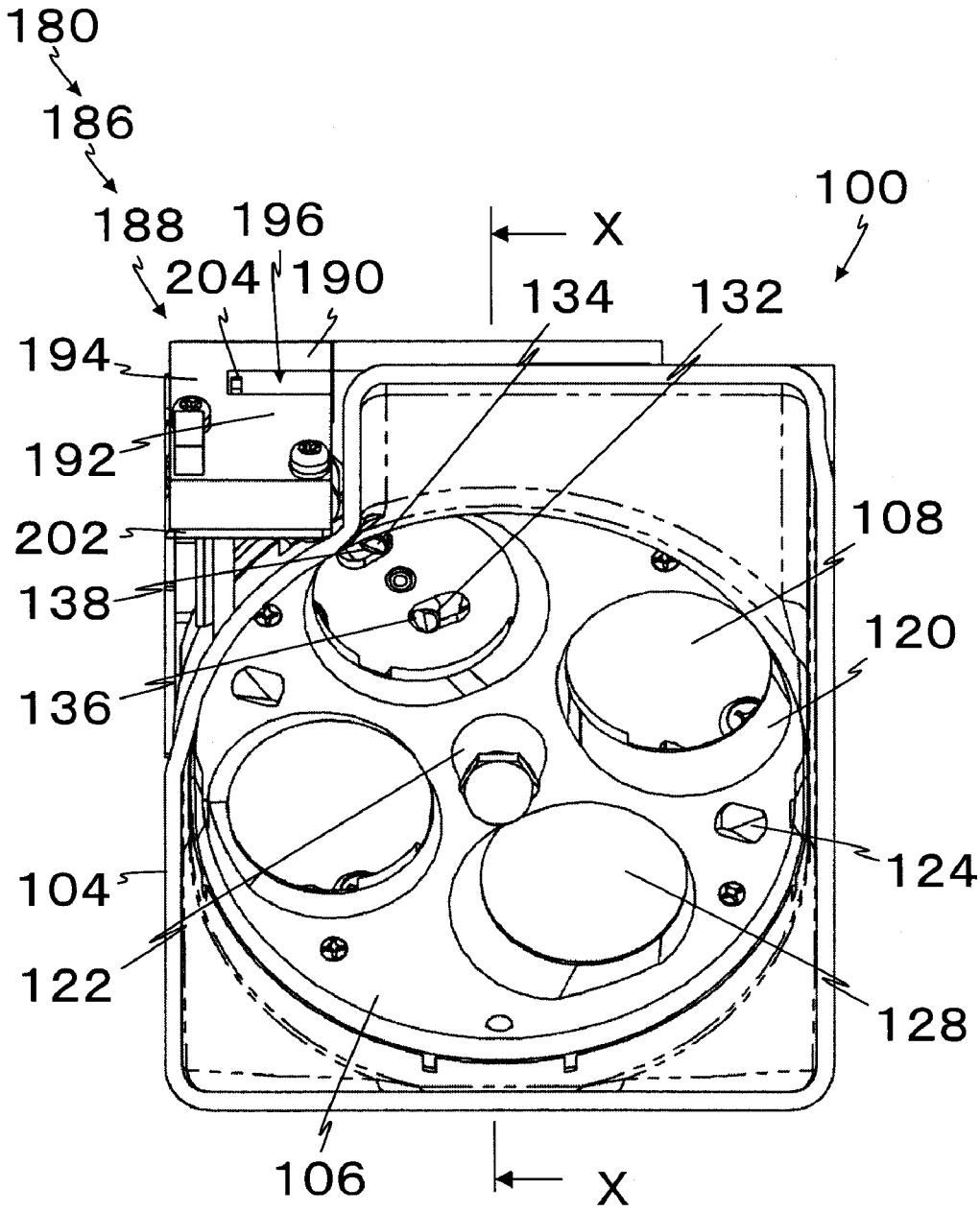
FIG. 2 is a plan view of the coin dispensing apparatus of the embodiment of FIG. 1.

Next, the rotating disk 106 will be explained. The rotating disk 106 has the function of sting the coins 102 in the storing bowl 104 and sorting the coins 102 to respective denominations or types. The rotating disk 106 is rotatably disposed in an inclined manner in the circular hole 130 of the base frame 140 positioned below the storing bowl 104 described below. The rotating disk 106 has a plurality of through holes 120 disposed at predetermined intervals, a cone-shaped sting portion 122 on a central portion of its upper face, mountain-shaped sting protrusions 124 disposed in the vicinity of its peripheral edge, and a pushing-out portion 126 for pushing the coins 102 out on its lower face. Therefore, the coins 102 which have dropped into the through hole 120, are retained on an upper face 128 of the base 108, and are rotated together with the rotating disk 106 in a counterclockwise direction by the pushing-out portion 126 of the rotating disk 106 forwardly rotating in a counterclockwise direction in FIG. 2 during coin dispensation. During this peripheral edges are thereof being guided to a periphery of a circular hole 130. The movement of the coins 102 rotated according to the rotation of the rotating disk 106 is blocked by pins 132 and 134. These pins 132 and 134 project at predetermined positions of the upper face 128 of the base 108. The coins are guided in a peripheral direction of the rotating disk 106. Since the circular hole 130 at this position is notched so that a dispensation opening 136 is formed, the coins 102 which have been pushed out can move to the outside of the circular hole 130. The pins 132 and 134 are biased by springs (not shown) so as to project from below the base 108 beyond the upper face 128, and inclined faces 136 and 138 are formed on upper end portions of the pins 132 and 134 on the sides opposite a forward rotational direction of the rotating disk 106. Thereby, when the rotating disk 106 rotates in reverse, the inclined faces 136 and 138 are pushed by the coins 102, so that the pins 132 and 134 are pushed downward against spring forces. Therefore, since the coins 102 get over the pins 132 and 134 and move together with the rotating disk 106 in a clockwise direction, the coins 102 are not dispensed from the dispensation opening 136.

The rotating disk 106 is attached on an upper end portion of a rotating shaft 139 rotatably attached so as to penetrate the base 108 so that the rotating disk 106 cannot slide in an axial line direction of the rotating shaft 139 and cannot rotate with respect to the rotating shaft 139. In detail, by interposing a shim having a low friction coefficient between the rotating disk 106 and the upper face 128 of the base 108, a distance therebetween is adjusted, and a position of the rotating disk 106 can be adjusted according to a thickness of the coin 102. In this case, by adjusting a distance between the upper face of the rotating disk 106 and a lower end edge of the coin dropper 116 in the range of the long hole 118, adjustment can be performed to an optimal positional relationship in which the coins 102 are not bitten into therebetween and the coins 102 are rapidly dropped into the through holes 120. However, the coin dropper 116 can be formed integrally with the storing bowl 104. Besides the shim, a position adjusting device for the rotating disk 106 with respect to the thickness of the coin 102 can be changed to another device having the same function as the aforementioned shim has. A position adjusting mechanism of the coin dropper 116 can also be changed to another device having the same function.

Next, the base 108 will be explained. The base 108 has the function of guiding the coins 102 rotated according to rotation of the rotating disk 106 on the flat upper face 128. The base 108 is fixed inside the circular hole 130 on the center of an upper face of the rectangular-box-shaped base frame 140, and inclined in a range of about 30 to 40 degrees. It is preferable that this angle of inclination is reduced, because a coin storing amount of the storing bowl 104 is increased according to the reduction. However, since a degree of influence of a diameter of the rotating disk 106 to the size of the storing bowl 104 increases, the angle of inclination is about 30 degrees at the minimum, and since dispensation efficiency of coins is degraded when the angle of inclination is large, the angle of inclination is about 60 degrees at the maximum. The circular hole 130 and the circular hole 114 positioned on the lower end portion of the storing bowl 104, are formed to have the same diameter, and integrated with each other. The base frame 140 has a box shape, and a reduction mechanism 142 described below and the like are disposed in an inner space of the base frame 140.

Next, the motor 110 will be explained. The motor 110 has the function of rotating the rotating disk 106 in a forward rotational direction and in a reverse rotational direction and a function of stopping the rotating disk 106. The motor 110 is disposed in the inner space of the base frame 140. Though an electric motor, an air motor, an oil hydraulic motor, or the like can be used as the motor 110, the electric motor is most preferable in view of size-reduction and easiness of control. A power source for the electric motor may be a DC power source or an AC power source, and further, one of motors of various types including an induction motor can be used, but a brushless DC motor can be forwardly and reversely rotated. This is desirable in view of size-reduction, maintenance easiness, and durability. The motor 110 performs a forward rotation for dispensing the coins 102, a reverse rotation for resolving a coin jam, and a stop which is a rapid stop performed by activating a rotating force in an opposite direction momentarily during forward or reverse rotation, in response to an instruction from a host controller (not shown). In the preferred embodiment, a forward rotation is a counterclockwise direction in each figure.

An output shaft (not shown) of the motor 110 rotates the rotating shaft 139 attached rotatably on the base frame 140 via the reduction mechanism 142 in a perpendicularly standing manner. Therefore, the rotating disk 106 is rotated in a forward rotational direction by the forward rotation of the motor 110, is rotated in a reverse rotational direction by the reverse rotation thereof, and the rotation thereof is stopped by the stop of the motor 110.

Next, the throwing-out device 112 will be explained. The throwing-out device 112 has the function of throwing out the coin 102 one by one in a predetermined direction. The throwing-out device 112 according to the preferred embodiment has the function of throwing out the coins 102 sent one by one by the rotating disk 106 in the predetermined direction forcefully. The throwing-out device 112 is disposed adjacent to the rotating disk 106 to face the dispensation opening 136. The throwing-out device 112 is composed of a fixed roller 156 (FIG. 5) which is disposed relative to the base 108 in a substantially fixed state and serves as a fixed guiding member 154 and a movable roller 160 which is disposed to be movable to the base 108 and is biased so as to approach to the side of the fixed guiding member 154 and which serves as a movable guiding member 158. The coin 102 is forcefully flipped out by a biasing force applied to the movable roller 160 by a biasing device 162, just after a diameter portion of the coin 102 passes through between the rollers. A throwing-out direction of the coin 102 of the throwing-out device 112 is oriented toward the rebound member 204 in a coin path 196 described below.

Figure 7:
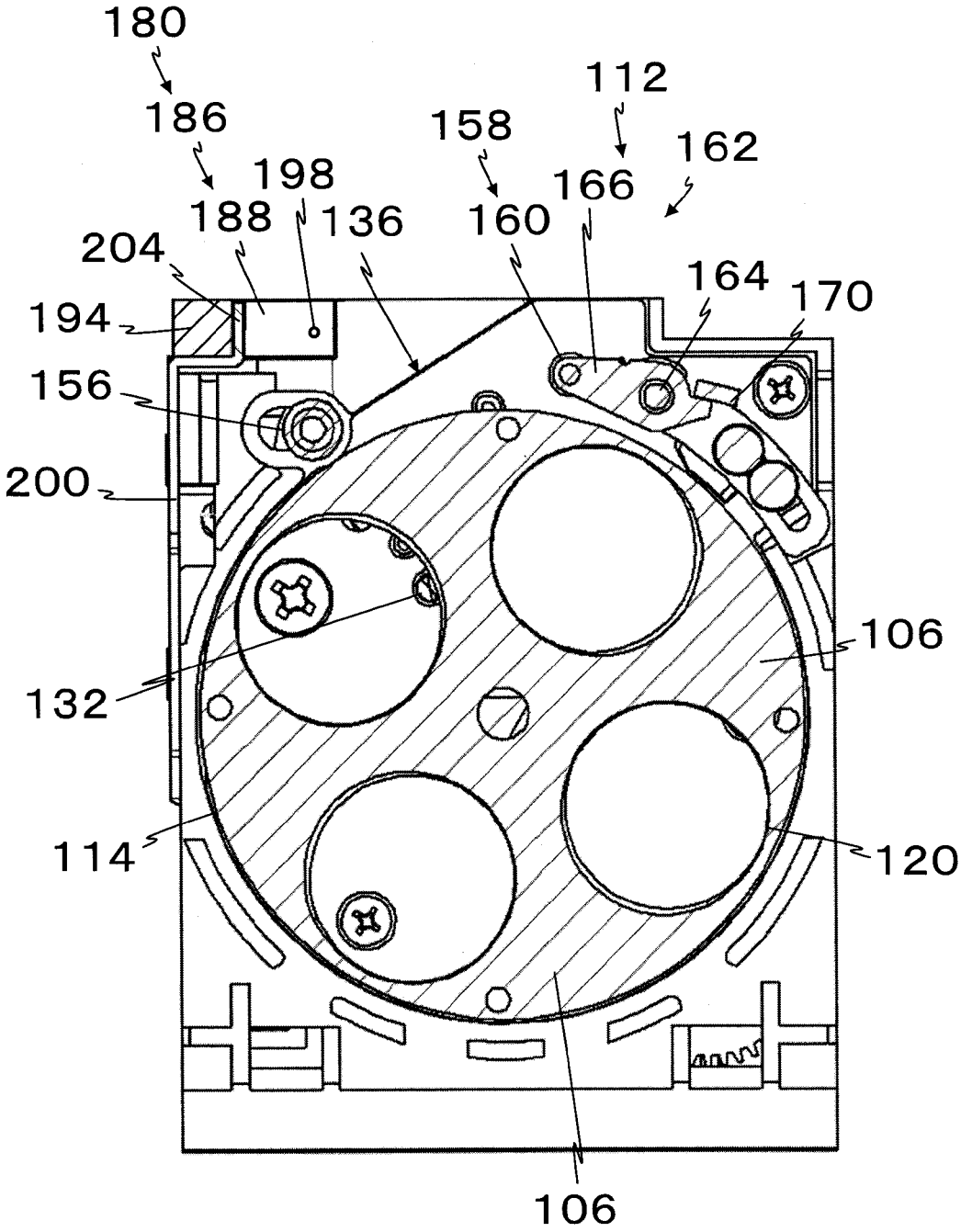
FIG. 7 is a sectional view of the coin dispensing apparatus of the embodiment of FIG. 1, taken along line Z-Z in FIG. 3.

Next, the biasing device 162 will be explained. The biasing device 162 has the function of applying a predetermined biasing force to the movable guiding member 158. In the biasing device 162, a lever 166, whose distal end is rotatably attached with the movable roller 160, is pivotally attached on a fixed shaft 164. The lever 166 is biased by a helical spring 168 so as to approach to the fixed roller 156. The lever 166 is stopped by a stopper 170 at a position where the movable roller 160 is close to the rotating disk 106 to be held at a standby position. When the fixed roller 156 and the movable roller 160 are at standby positions, a space between the fixed roller 156 and the movable roller 160 is set to be smaller than the diameter of the coin 102. On the other hand, since the coin 102 pushed out by the pushing-out portion 126 while being guided by the pins 132 and 134 is guided at its one side by the fixed roller 156, the movable roller 160 is moved in a clockwise direction in FIG. 5 and FIG. 7, and the lever 166 is caused to pivot in a clockwise direction. The spring force of the spring 168 is accumulated according to pivot of the lever 166 in a clockwise direction. Just after the diameter portion of the coin 102 passes in between the fixed roller 156 and the movable roller 160, the lever 166 is caused to pivot rapidly in a counterclockwise direction by the spring force accumulated in the spring 168, so that the coin 102 is flipped out in a predetermined direction and thrown out. In particular, since the coin 102 is flipped out along the inclined base 108, the coin 102 is thrown out obliquely upward, and the coin 102 goes straight toward the coin path 196 described below and strikes against the rebound member 204.

Next, the coin detecting device 180 will be explained. The coin detecting device 180 has the function of detecting the coin 102 thrown out by the throwing-out device 112 to output a coin signal. The coin detecting device 180 detects the coins 102 thrown out one by one according to the rotation of the rotating disk 106 by the throwing-out device 112 with no contact to output a coin signal CS to the host controller (not shown). The coin detecting device 180 is a noncontact type coin detecting device 186, and one of a photoelectric type, an electromagnetic type, an acoustic wave type, or the like can be used, but it is preferable that an electromagnetic type coin detecting device 188 which is hardly influenced by dust, debris, refuse, or the like is used in view of the low maintenance. The electromagnetic type coin detecting device 188 is attached on the base frame 140 on the side of the throwing-out device 112 via a bracket 200 described below.

Next, the electromagnetic type coin detecting device 188 will be explained. The electromagnetic type coin detecting device 188 is formed in a rod shape and includes a lower detecting unit 190 (FIG. 4) disposed approximately horizontally on its lower side, and an upper detecting unit 192 provided in parallel with the lower detecting unit 190 so as to be spaced from the lower detecting unit 190 by a predetermined distance. In the electromagnetic type coin detecting device 188, the lower detecting unit 190 and the upper detecting unit 192 are connected to each other by a connecting portion 194 extending in a vertical direction, and the slit-shaped coin path 196 is provided between the lower detecting unit 190 and the upper detecting unit 192, so that the electromagnetic type coin detecting device 188 is formed into a channel shape as a whole. An upper face of the lower detecting unit 190 is positioned on the same plane as the upper face of the base frame 140 is positioned. The upper face of the lower detecting unit 190 and a lower face of the upper detecting unit 192 are separated from each other by a distance of about three times the thickness of the coin 102. The coin path 196 is disposed such that the coin path 196 includes an advancing route of the coin 102 thrown out by the throwing-out device 112. In other words, the coin 102 thrown out by the throwing-out device 112 moves while avoiding striking against the lower detecting unit 190 and the upper detecting unit 192. However, when the throwing-out direction deviates, the coin 102 advances while being guided by the upper face of the lower detecting unit 190 and the lower face of the upper detecting unit 192. Sensors 198 for coin detection are disposed opposite each other on the lower detecting unit 190 and the upper detecting unit 192. In the case of the electromagnetic type coin detecting device 188, a magnetic coil is provided, and in a case of a photoelectric type coin detecting device, a light emitting and receiving device is provided. The electromagnetic type coin detecting device 188 is fixed on the metal bracket 200 fixed on a side face of the base frame 140. The bracket 200 is fixed on the side face of the base frame 140, and a distal end of the bracket 200 is bent at a right angle to form a plate-like attaching plate 202 extending in a direction perpendicular to a plane including an upper face 128 of the base 108. The attaching plate 202 is formed into a size approximately covering the upper detecting unit 192. This is for preventing the coin 102 thrown out by the thrown-out device 112 from striking against the electromagnetic type coin detecting device 188 accidentally and damaging the same.

Next, the rebound member 204 will be explained. The rebound member 204 has the function of causing the coin 102 to rebound in a predetermined direction when the coin 102 thrown out by the throwing-out device 112 strikes against the rebound member 204. The rebound member 204 is formed in a flat plate shape by protruding a part of the plate 202. The rebound member 204 is inserted into the coin path 196 of the electromagnetic type coin detecting device 188, and is disposed adjacent to a side face of the connecting portion 194. The rebound member 204 is disposed in a depth portion of the coin path 196 to cover the side face of the connecting portion 194 entirely. The rebound member 204 can be made up as a member separated from the plate 202 to be disposed in the coin path 196. The rebound member 204 can be fixed on the side face of the connecting portion 194 to be integrated with the electromagnetic type coin detecting device 188. Further, when the rebound member 204 has predetermined durability, the rebound member 204 can be molded using material other than metal, for example, resin. Further, in order to adjust a rebounding direction of the coin 102, it is preferable that the rebound member 204 is provided so as to be adjustable regarding its position.

Figure 8A:
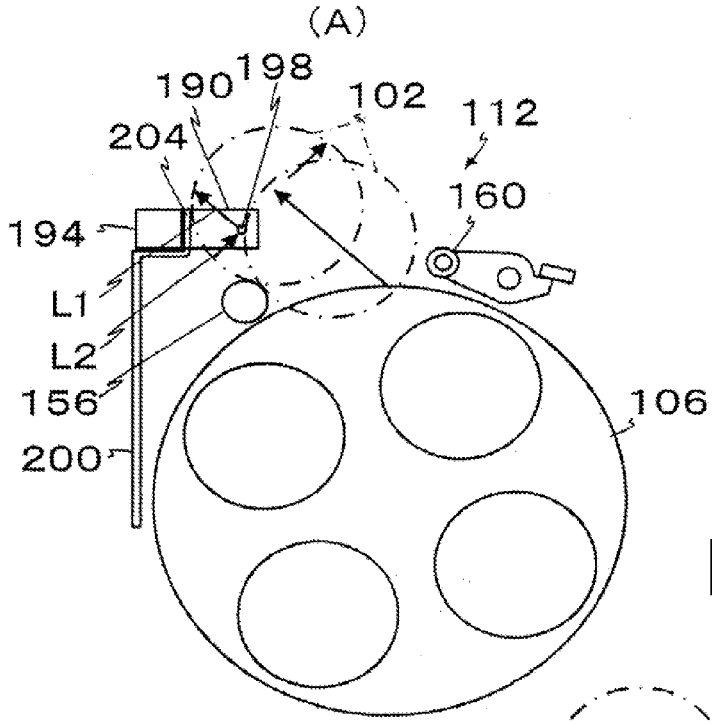
FIG. 8A is a functional explanatory view of the coin dispensing apparatus of the embodiment of FIG. 1.

Next, a function of the embodiment will be explained with reference to FIG. 8. The motor 110 rotates so that the rotating disk 106 is rotated via the reduction mechanism 142 in a counterclockwise direction in FIG. 2. According to the rotation of the rotating disk 106, the coin 102 dropped into the through hole 120 is pushed and moved by the pushing-out portion 126, and rotated according to the rotation thereof. In the course of being rotated according to the rotation of the rotating disk 106, the coin 102 is guided in a peripheral direction of the rotating disk 106 by the pins 132 and 134, and flipped out by the throwing-out device 112. Since the coin 102 is guided by the base 108 at this time, the coin 102 is flipped out obliquely upward, based upon the inclination of the base 108. The flipped-out coin 102 advances into the coin path 196 and strikes against the rebound member 204 at an acute incident angle. The struck coin 102 is repelled in a predetermined direction, namely, approximately at the same angle as the incident angle. When the coin 102 faces the sensor 198, the electromagnetic type coin detecting device 188 outputs the coin signal CS. As shown in FIG. 8A, the electromagnetic type coin detecting device 188 outputs the coin signal CS over a length L1 from after a peripheral edge of the coin 102 faces the sensor 198 until the coin strikes against the rebound member 204, and further outputs the coin signal CS over a length L2 from after the coin 102 strikes against the rebound member 204 to be rebounded until the facing between the peripheral edge of the coin and the sensor 198 is terminated. In other words, the coin signal CS is continuously output from just before the coin 102 strikes against the rebound member 204 to just after the coin is rebounded. When the coin signal CS is continued for no less than a predetermined time period which is a reference time period, for example, as shown in FIG. 8C, for no less than a time period ST, a detection signal CU is output, and when the number of the detection signals CU reaches the number of dispensation instructions, the motor 110 is subjected to electric brake during a predetermined time period to be stopped rapidly. Since a time period obtained by summing the lengths L1 and L2 of the signal constitutes the coin signal CS, the detection signal CU can be output even if the coin 102 is a small-diameter coin.

Figure 8B:
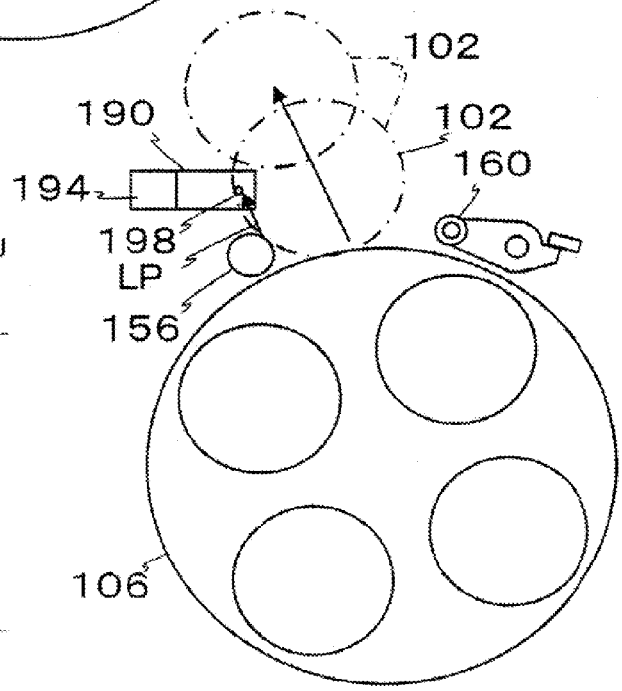
FIG. 8B is a functional explanatory view of a conventional apparatus.
Figure 8C:
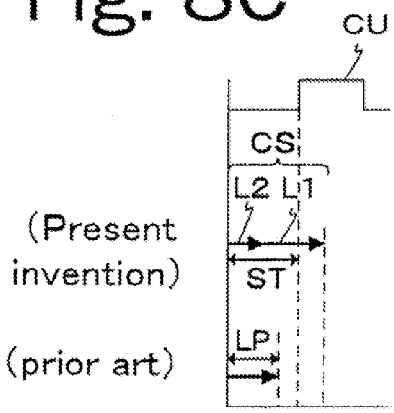
FIG. 8C is an explanatory view of an effect of FIG. 1.

In a conventional apparatus, as shown in FIG. 8B, the coin 102 is thrown out by the throwing-out device 112 in a direction in which the coin 102 does not strike against the connecting portion 194. The sensor 198 outputs the coin signal CS over a length LP of a string facing the coin 102. As shown in FIG. 8C, since a length of the coin signal CS in the conventional apparatus is shorter than the reference time period ST, the detection signal CU is not output. Therefore, according to the present invention, since the coin signal CS having a length enough to output the detection signal CU can be obtained even if a small-diameter coin is used, there is an advantage of being capable of detecting the coin reliably.

While specific embodiments of the invention have been shown and described in particular to illustrate the application of the principles of the invention, it will be understood that the invention may be embodied otherwise without departing from such principles.

APPENDIX

100: coin dispensing apparatus
102: coin
106: rotating disk
112: throwing-out device
120: through hole
154: fixed guiding member
158: movable guiding member
186: noncontact type coin detecting device
188: electromagnetic type coin detecting device
190: lower detecting device
192: upper detecting device
194: connecting portion
196: coin path
204: rebound member

What is claimed is:

1. A coin dispensing apparatus comprising:

a sorter comprising a rotating disk for sorting coins to respective denominations, said rotating disk comprising a through hole into which coins drop through, said rotating disk comprising a pushing-out portion on a lower face thereof, wherein said rotating disk separates coins one by one;

a base for guiding the coins rotated by said rotating disk, said base being inclined at an angle between 30 degrees to 40 degrees, said sorter being parallel to said base;

a throwing-out device comprising a fixed roller and a movable roller, said fixed roller being fixed relative to said base, said throwing-out device being fixed relative to said base, said fixed roller being fixed adjacent to an inclined upper side of said rotating disk and an edge of said base, said movable roller being movable relative to said base, said movable roller being adjacent to said inclined upper side of said rotating disk and a middle portion of said base, said movable roller being biased such that said movable roller approaches a side of said fixed roller, wherein said fixed roller and said movable roller move coins one by one along said base in an upward direction toward said edge of said base such that one face of each coin faces in an upward direction and another face of each coin faces in a downward direction;

an electromagnetic non-contact type coin detecting device detecting coins one by one from said throwing-out device, said electromagnetic coin detecting device being formed into a channel shape, said coin detecting device comprising a lower detecting unit, an upper detecting unit and a connecting portion, said lower detecting unit being disposed substantially horizontally, said lower detecting unit being located substantially aligned with said upper surface of said base, said upper detecting unit being provided in parallel with said lower detecting unit at a spaced location from said lower detecting unit via said connecting portion, wherein a slit shaped coin path is defined by at least a portion of said lower detecting unit and at least a portion of said upper detecting unit;

a metal bracket comprising a protruding part, said protruding part comprising a tip portion, said metal bracket being attached a side of said movable roller of said base;

a rebound member defined by said tip portion of said protruding part of said metal bracket, said tip portion being parallel to said metal bracket, said rebound member being located outside of said fixed roller and in an upward direction from said fixed roller, said rebound member being inserted into the coin path from a side of said fixed roller, wherein said rebound member is adjacent to said connecting portion, said movable roller and said fixed roller moving coins in a direction of said rebound member such that said coins move in a first coin traveling direction toward an upper corner of said base, each of said coins engaging said rebound member at an acute angle such that said rebound member alter a travel path of said coins, wherein each of said coins move in a second coin traveling direction, wherein each of said coins move toward an extended line of said middle of said base in said second coin traveling direction, said first coin traveling direction being different from said second coin traveling direction, said first coin traveling direction being perpendicular to said second coin traveling direction, said coin detecting device continuously detecting said coins before said coins contact said rebound member and said coin detecting device detecting said coins after said coins contact said rebound member.

2. A coin dispensing apparatus according to claim 1, wherein:

said pair of detecting units form a detecting path through which coins pass and said connecting portion connects the detecting units to each other; and said rebound member is disposed on the connecting member positioned in a depth portion of the detecting path.

3. A coin dispensing apparatus according to claim 2, wherein the rebound member is formed as a member separated from the noncontact type detecting device and is disposed in the depth portion of the detecting path.

4. A coin dispensing apparatus, comprising:

a sorter for sorting coins to respective denominations or type and including a rotating disk having a through hole into which coins drop through, said rotating disk comprising a pushing-out portion on a lower face thereof;

a base for guiding the coins rotated by said rotating disk, said base having an inclined surface, said inclined surface extending at an angle between 30 degrees to 40 degrees with respect to horizontal, said sorter being parallel to said base;

a feed out device with a fixed guiding member and a movable guiding member, said fixed guiding member being fixed relative to said base and adjacent to an inclined upper side of said rotating disk and an edge of said base, said movable roller being movable relative to said base, said movable roller being adjacent to said inclined upper side of said rotating disk and a middle portion of said base, said movable roller being biased such said movable roller approaches a side of said fixed roller, said fixed roller and said movable roller moving the coins one by one along said inclined surface in an upward direction toward said edge of said base, wherein one face of each coin faces in a downward direction;

a bracket comprising a protruding part, said bracket being attached to said base, said protruding part comprising a tip portion, tip portion being parallel to said bracket;

a rebound member defined by at least a portion of said tip portion, said rebound member being located at a spaced location from said fixed guiding member, wherein said rebound member is located at a position in an upward direction from said fixed guiding member, said movable guiding member and said fixed guiding member flipping out coins in a direction of said rebound member such that said coins move in a first coin traveling direction, wherein each of said coins moves toward an upper corner of said base in said first traveling direction, each of said coins engaging said rebound member at an acute angle such that each of said coins move in a second coin traveling direction after each of said coins engage said rebound member, said first coin traveling direction being different from said second coin traveling direction, said first coin traveling direction being perpendicular to said second coin traveling direction; and an electromagnetic noncontact type detecting device formed into a channel shape, said noncontact type detecting device detecting coins thrown out via said feed out device one by one, said electromagnetic noncontact type detecting device comprising a lower detecting unit, an upper detecting unit and a connecting portion, said lower detecting unit being located at a spaced location from said upper detecting unit via said connecting portion, said lower detecting unit being substantially horizontal, said lower detecting unit being substantially aligned with an upper surface of said base, said upper detecting unit being parallel with said lower detecting unit, at least a portion of said lower detecting unit and at least a portion of said upper detecting unit defining a slit-shaped coin path, said rebound member being inserted into said coin path on a side of said fixed guiding member, said rebound member being adjacent to said connecting portion, wherein said noncontact type device detects each coin moving in said first coin traveling direction before striking against the rebound member and said noncontact type detecting device detects each of said coins moving in said second coin traveling direction after each of said coins contact said rebound member.

5. A coin dispensing apparatus according to claim 4, wherein:

said rebound member is disposed on the connecting member positioned in a depth portion of the detecting path.

6. A coin dispensing apparatus according to claim 5, wherein the rebound member is formed as a member separated from the noncontact type detecting device and is disposed in the depth portion of the detecting path.

7. A coin dispensing apparatus comprising:

a sorter for sorting coins to respective denominations or type and including a rotating disk having a through hole into which coins drop through to a dispensing location;

a base frame guiding the coins rotated by said rotating disk, said base frame being inclined at an angle between thirty degrees and forty degrees, said sorter being parallel to said base frame;

a dispensing device throwing out coins from the dispensing location with a throw out path in a substantially inclined direction;

a bracket comprising a protruding part, said protruding part comprising an end portion, said end portion being parallel to said protruding part;

a rebound member, said end portion forming said rebound member, said rebound member being arranged at an upper corner of said base frame, said throw out path being in a direction of said rebound member, each of said coins being thrown out along said throw out path via said dispensing device such that each of said coins strike said rebound member and move along a rebound path, said rebound path being perpendicular to said throw out path; and a noncontact type coin detecting device with a detection region, said detecting device and said metal bracket being fixed on said base frame, said throw out path and said rebound path passing through said detection region, said noncontact type coin detecting device detecting each of said coins along said throw out path before striking against the rebound member and said noncontact type coin detecting device detecting each of said coins along said rebound path after each of said coins strike against the rebound member.

8. A coin dispensing apparatus according to claim 7, wherein said dispensing device includes a fixed guiding member and a movable guiding member, which is resiliently biased.

9. A coin dispensing apparatus according to claim 7, wherein the noncontact type detecting device is an electromagnetic type coin detecting device.

10. A coin dispensing apparatus according to claim 7, wherein:

said noncontact type detecting device comprising a connecting portion and a pair of detecting units, said noncontact type detecting device being formed into a channel shape, wherein said pair of detecting units form a detecting path through which coins pass and said connecting portion connect the detecting units to each other; and said rebound member is disposed on the connecting member positioned in a depth portion of the detecting path.

11. A coin dispensing apparatus according to claim 10, wherein the rebound member is formed as a member separated from the noncontact type detecting device and is disposed in the depth portion of the detecting path.

12. A coin dispensing apparatus according to claim 1, further comprising:

a motor, said noncontact type coin detecting device providing a coin signal as output, said coin signal being based on said detection of said coins before striking said rebound member and after striking said rebound member, said motor being controlled based on said coin signal.

13. A coin dispensing apparatus according to claim 4, further comprising:

a motor, said feed out device providing a coin signal as output, said coin signal being based on said detection of said coins before striking said rebound member and after striking said rebound member, said motor being controlled based on said coin signal, said motor being stopped after said motor receives said coin signal for a predetermined time period.

14. A coin dispensing apparatus according to claim 7, further comprising:

a motor, said dispensing device providing a coin signal as output, said coin signal being based on said detection of said coins before striking said rebound member and after striking said rebound member, said motor being controlled based on said coin signal.

15. A coin dispensing apparatus according to claim 1, wherein at least a portion of said feed out device is located adjacent to said rebound member.

16. A coin dispensing apparatus according to claim 4, wherein at least a portion of said noncontact type detecting device is located adjacent to said rebound member.

17. A coin dispensing apparatus according to claim 7, wherein at least a portion of said noncontact type detecting device is located adjacent to said rebound member.

18. A coin dispensing apparatus according to claim 7, wherein said coin detecting device is an electromagnetic detecting device, said detecting device comprising a lower detecting unit, an upper detecting unit and a connecting portion, said lower detecting unit being connected to said upper detecting unit via said connecting portion, said lower detecting unit being located at a spaced location from said upper detecting unit, said lower detecting unit being substantially horizontal, said upper detecting unit being parallel with said lower detecting unit, at least a portion of said upper detecting unit and at least a portion of said lower detecting unit defining a slit shaped coin path, said rebound member being adjacent to said connecting portion, said rotating disk comprising a pushing-out portion on a lower surface thereof, said rotating disk separating coins one by one, said dispensing device comprising a fixed roller and a movable roller, said movable roller being biased such that said movable roller approaches a side of said fixed roller, wherein said movable roller is movable relative to said base frame, said fixed roller being fixed relative to said base and adjacent to an inclined upper side of said rotating disk and an edge of said base, said movable roller being adjacent to said inclined upper side of said rotating disk and a middle portion of said base, said fixed roller and said movable roller moving the coins one by one along said inclined surface of said base frame in an upward direction toward an edge of said base such that one surface of each coin is in contact with said inclined surface, said rebound member being located at a spaced location from said fixed roller, wherein said rebound member is located in an upward direction from said fixed roller, said movable roller and said fixed roller flipping out coins in a direction of said rebound member such that said coins move along said throw out path, wherein each of said coins moves toward an upper corner of said base frame along said throw out path, each of said coins engaging said rebound member at an acute angle such that each of said coins move along said rebound path after each of said coins engage said rebound member, said throw out path being different from said rebound path, said lower detecting unit being substantially aligned with an upper surface of said base, said rebound member being inserted into said throw out path on a side of said fixed roller, said rebound member being adjacent to said connecting portion.

* * * * *